US010573262B2

(12) United States Patent
Chen et al.

(10) Patent No.: US 10,573,262 B2
(45) Date of Patent: Feb. 25, 2020

(54) DATA VOLTAGE STORAGE CIRCUIT, METHOD FOR DRIVING THE SAME, LIQUID CRYSTAL DISPLAY PANEL, AND DISPLAY DEVICE

(71) Applicants: BOE Technology Group Co., Ltd., Beijing (CN); Hefei BOE Optoelectronics Technology Co., Ltd., Hefei, Anhui (CN)

(72) Inventors: Yimin Chen, Beijing (CN); Xianjie Shao, Beijing (CN); Xiujuan Wang, Beijing (CN); Zhangmeng Wang, Beijing (CN)

(73) Assignees: BOE Technology Group Co., Ltd., Beijing (CN); Hefei BOE Optoelectronics Technology Co., Ltd., Hefei (CN)

( * ) Notice: Subject to any disclaimer, the term of this patent is extended or adjusted under 35 U.S.C. 154(b) by 49 days.

(21) Appl. No.: 15/934,060

(22) Filed: Mar. 23, 2018

(65) Prior Publication Data

US 2019/0088214 A1 Mar. 21, 2019

(30) Foreign Application Priority Data

Sep. 20, 2017 (CN) ..... 2017 1 0851223

(51) Int. Cl.
*G09G 3/36* (2006.01)

(52) U.S. Cl.
CPC ..... *G09G 3/364* (2013.01); *G09G 3/3648* (2013.01); *G09G 2300/0857* (2013.01)

(58) Field of Classification Search
CPC ..... G09G 3/364; G09G 3/3648; G09G 2300/0857
See application file for complete search history.

(56) References Cited

U.S. PATENT DOCUMENTS

2005/0236650 A1* 10/2005 Edwards ..... G09G 3/3648 257/203
2009/0002303 A1* 1/2009 Huang ..... G09G 3/3655 345/89
2009/0268115 A1* 10/2009 Hagino ..... G09G 3/3655 349/39
2010/0103357 A1* 4/2010 Kye ..... G02F 1/133711 349/123
2015/0192772 A1* 7/2015 Lewis ..... G02B 26/023 345/690

(Continued)

*Primary Examiner* — Nitin Patel
*Assistant Examiner* — Amy Onyekaba
(74) *Attorney, Agent, or Firm* — Arent Fox LLP; Michael Fainberg

(57) ABSTRACT

The disclosure discloses a data voltage storage circuit, a method for driving the same, a liquid crystal display, and a display device, and the data voltage storage circuit includes a voltage input subcircuit, a storage control subcircuit, and an output control subcircuit; and the storage control subcircuit stores a data signal input to the first node, so that the data signal can be stored for a long period of time. The three subcircuits above cooperate with each other so that a signal output end can be provided with a signal of a second reference voltage signal end or a common voltage signal end using the simple structure to thereby lower the difficulty of a fabrication process thereof, narrow a space to be occupied by the circuit, and improve a pixel aperture ratio.

20 Claims, 4 Drawing Sheets

(56) References Cited

U.S. PATENT DOCUMENTS

2015/0194102 A1* 7/2015 Lewis ..... G09G 3/3466
345/85
2017/0153481 A1* 6/2017 Wang ..... G02F 1/13394

* cited by examiner

DATA VOLTAGE STORAGE CIRCUIT, METHOD FOR DRIVING THE SAME, LIQUID CRYSTAL DISPLAY PANEL, AND DISPLAY DEVICE

CROSS-REFERENCE TO RELATED APPLICATIONS

This application claims the priority to Chinese Patent Application No. 201710851223.2, filed on Sep. 20, 2017, the content of which is hereby incorporated by reference in its entirety.

FIELD

The present disclosure relates to the field of display technologies, and particularly to a data voltage storage circuit, a method for driving the same, a liquid crystal display panel, and a display device.

BACKGROUND

With rapid development of display technologies, a Liquid Crystal Display (LCD) panel has been widely applied to various electronic devices due to is low power consumption, low driving voltage, and other advantages. Particularly the LCD panel is categorized into a transmissive LCD panel and a reflective LCD panel. The transmissive LCD panel displays an image using an internal light source, e.g., a backlight source, and the reflective LCD panel displays an image using an external light source, e.g., natural sunlight. Since the reflective LCD panel does not need the internal light source, e.g., the backlight source, the reflective LCD panel can be made thinner and more lightweight, and have lower power consumption, and thus can be applicable to wearable devices with required low power consumption.

At present, the reflective LCD panel generally operates with the Memory In Pixel (MIP) energy-saving technology to thereby low its power consumption. In the MIP technology, a Static Random Access Memory (SRAM) is arranged in each pixel of the reflective LCD panel to store data voltage input to the pixel for some display period of time for displaying, so as to avoid the data voltage from being written repeatedly, which would otherwise consume more power. However the SRAM generally includes at least two NOT gate circuits, so that there are such a large number of transistors in the SRAM that a large area of the pixel is occupied by the SRAM, thus lowering a pixel aperture ratio.

SUMMARY

Some embodiments of the disclosure provide a data voltage storage circuit including a voltage input subcircuit, a storage control subcircuit, and an output control subcircuit, wherein: the voltage input subcircuit is coupled respectively to a scan signal end, a data signal end and a first node, and is configured to provide the first node with a data signal of the data signal end under control of the scan signal end; the storage control subcircuit is coupled to the first node and a first reference voltage signal end, and is configured to stabilize voltage of the first node; and the output control subcircuit is coupled respectively to a second reference voltage signal end, a common voltage signal end, the first node and a signal output end of the data voltage storage circuit, and is configured to provide the signal output end with the signal of the second reference voltage signal end or a signal of the common voltage signal end under joint control of the second reference voltage signal end and a signal of the first node.

Some embodiments of the disclosure further provide a method for driving the data voltage storage circuit above according to any one of the implementations above of the disclosure, the method including: providing, by the voltage input subcircuit, the first node with the data signal of the data signal end under control of the scan signal end; stabilizing, by the storage control subcircuit, the voltage of the first node; and providing, by the output control subcircuit, the signal output end with the signal of the second reference voltage signal end or the signal of the common voltage signal end under joint control of the second reference voltage signal end and a signal of the first node.

Some embodiments of the disclosure further provide a liquid crystal display panel including the data voltage storage circuit above according to any one of the implementations above of the disclosure.

Some embodiments of the disclosure further provide a display device including the liquid crystal display panel above according to any one of the implementations above of the disclosure.

DETAILED DESCRIPTION OF THE EMBODIMENTS

In order to make the objects, technical solutions, and advantages of the disclosure more apparent, particular implementations of a data voltage storage circuit, a method for driving the same, a liquid crystal display panel, and a display device according to the embodiments of the disclosure will be described below in details with reference to the drawings. It shall be appreciated that the preferred embodiments to be described below are merely intended to illustrate and explain the disclosure, but not to limit the disclosure thereto. Moreover the embodiments of the disclosure and the features in the embodiments can be combined with each other unless they conflict with each other.

Figure 1A:
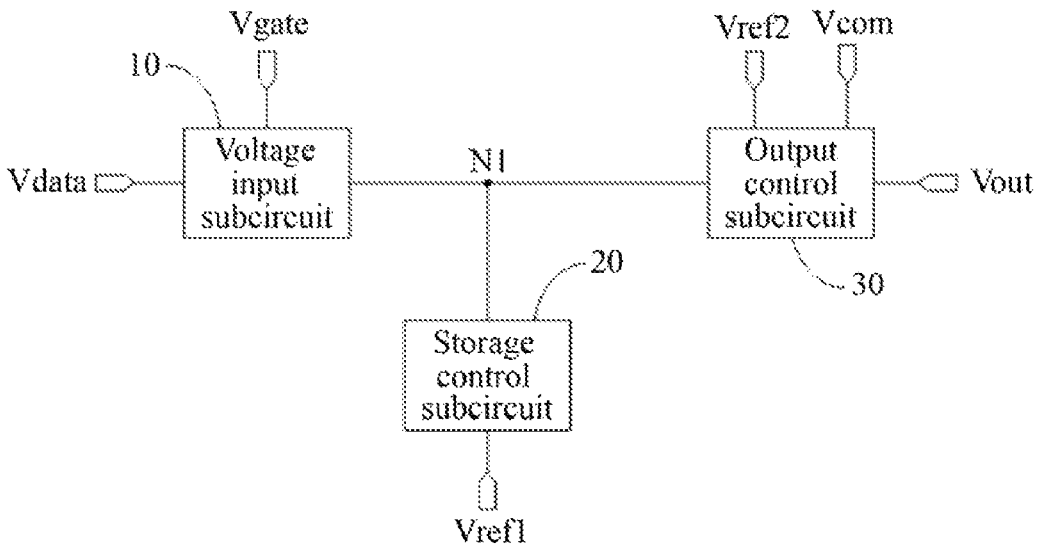
FIG. 1A is a first schematic structural diagram of a data voltage storage circuit according to an embodiment of the disclosure.

An embodiment of the disclosure provides a data voltage storage circuit as illustrated in FIG. 1A including a voltage input subcircuit 10, a storage control subcircuit 20, and an output control subcircuit 30.

The voltage input subcircuit 10 is coupled respectively to a scan signal end Vgate, a data signal end Vdata and a first node N1, and the voltage input subcircuit 10 is configured to provide the first node N1 with a data signal of the data signal end Vdata under control of the scan signal end Vgate.

The storage control subcircuit 20 is coupled to the first node N1 and a first reference voltage signal end Vref1, and is configured to stabilize voltage of the first node N1.

The output control subcircuit 30 is coupled respectively to a second reference voltage signal end Vref2, a common voltage signal end Vcom, the first node N1 and a signal output end Vout of the data voltage storage circuit, and is configured to provide the signal output end Vout with the signal of the second reference voltage signal end Vref2 or a signal of the common voltage signal end Vcom under joint control of the second reference voltage signal end Vref2 and a signal of the first node N1.

The data voltage storage circuit according to the embodiment of the disclosure includes the voltage input subcircuit, the storage control subcircuit and the output control subcircuit, where the voltage input subcircuit is configured to provide the first node with the data signal of the data signal end under control of the scan signal end; the storage control subcircuit is configured to stabilize voltage of the first node; and the output control subcircuit is configured to provide the signal output end with the signal of the second reference voltage signal end or the signal of the common voltage signal end under joint control of the second reference voltage signal end and the signal of the first node. Accordingly in the data voltage storage circuit according to the embodiment of the disclosure, the storage control subcircuit is arranged to store the data signal input to the first node, so that the data signal can be stored for a long period of time. Furthermore the three subcircuits above cooperate with each other so that the signal output end can be provided with the signal of the second reference voltage signal end or the common voltage signal end using the simple structure to thereby lower the difficulty of a fabrication process thereof, narrow a space to be occupied by the circuit, and improve a pixel aperture ratio. When the data voltage storage circuit is applied to a liquid crystal display panel, the signal of the second reference voltage signal end and the signal of the common voltage signal end are input respectively into a pixel electrode. When the signal of the second reference voltage signal end is input to the pixel electrode, a difference in voltage can be formed across a liquid crystal layer to drive liquid crystals to be inverted to thereby display a white image; and when the signal of the common voltage signal end is input to the pixel electrode, there is no difference in voltage across the liquid crystal layer, and no liquid crystals are inverted, so that a black image is displayed on the liquid crystal display panel.

In a particular implementation, when the data voltage storage circuit according to the embodiment of the disclosure is applied to a liquid crystal display panel, the signal of the common voltage signal end in the data voltage storage circuit according to the embodiment of the disclosure is the same as a signal at a common electrode layer in the liquid crystal display panel.

In a particular implementation, in the data voltage storage circuit according to the embodiment of the disclosure, the first reference voltage signal end can be a grounded end. Or in order to reduce the number of signal ends, and to simplify wiring, the first reference voltage signal end can be the same signal end as the common voltage signal end.

In a particular implementation, in the data voltage storage circuit according to the embodiment of the disclosure, the voltage of the signal of the second reference voltage signal end is different from the voltage of the signal of the common voltage signal end. Particularly the voltage of the signal of the second reference voltage signal end can be high voltage. In a real application, the voltage of the signal of the second reference voltage signal end needs to be designed and determined for a real application environment, although the embodiment of the disclosure will not be limited thereto.

Figure 1B:
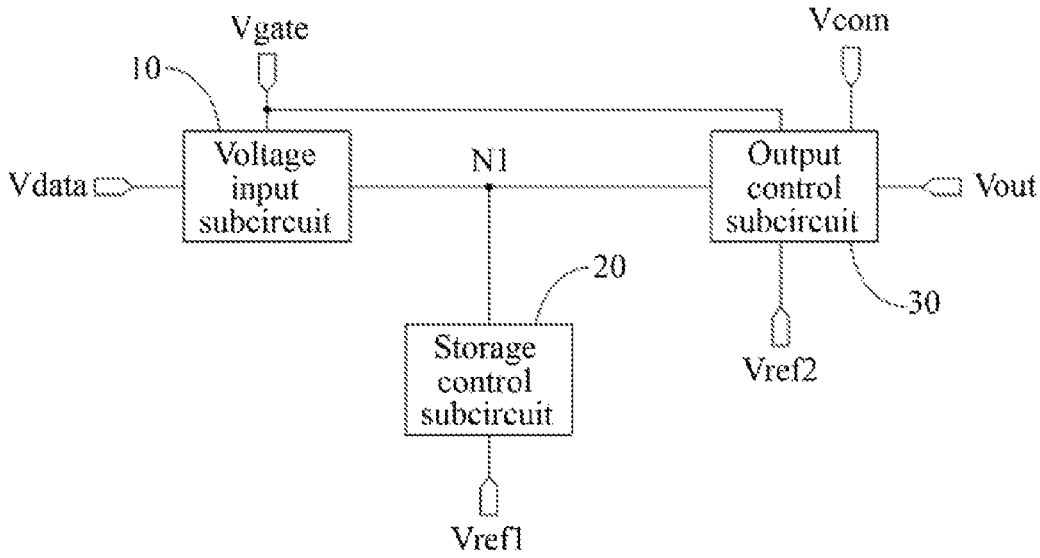
FIG. 1B is a second schematic structural diagram of a data voltage storage circuit according to an embodiment of the disclosure.

Furthermore in order to improve a pathway for outputting the signal of the second reference voltage signal end, in a particular implementation, in the data voltage storage circuit according to the embodiment of the disclosure, as illustrated in FIG. 1B, the output control subcircuit 30 is further coupled to the scan signal end Vgate, and is configured to provide the signal output end Vout with the signal of the second reference voltage signal end Vref2 or the signal of the common voltage signal end Vcom under joint control of the signal of the first node N1 and the scan signal end Vgate.

The disclosure will be described below in details in connection with a particular embodiment thereof. It shall be noted that the embodiment is intended to better illustrate the disclosure, but not to limit the disclosure thereto.

Figure 2A:
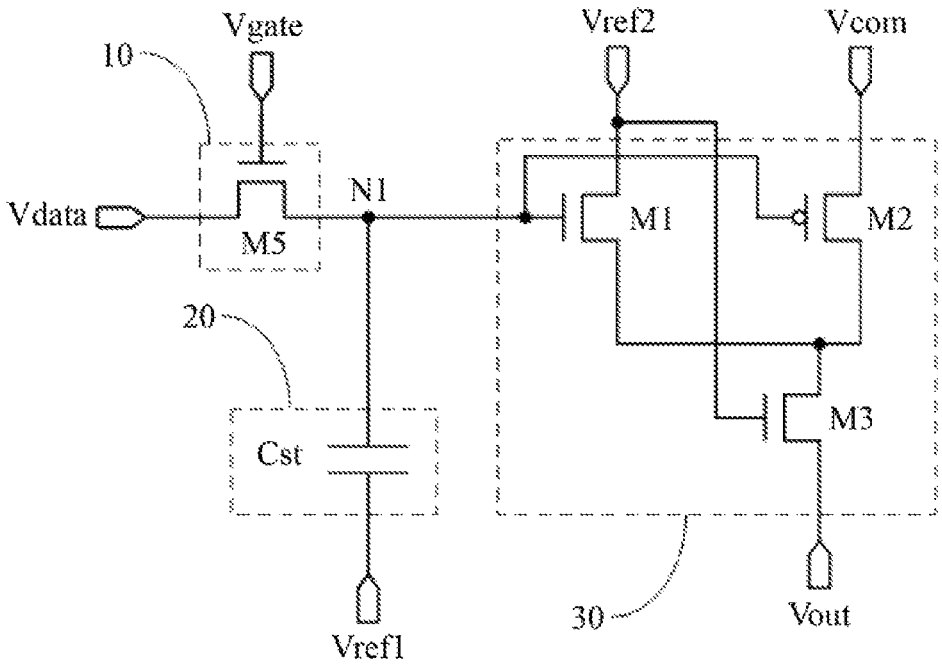
FIG. 2A is a first schematic structural diagram of a data voltage storage circuit in details according to an embodiment of the disclosure.
Figure 2B:
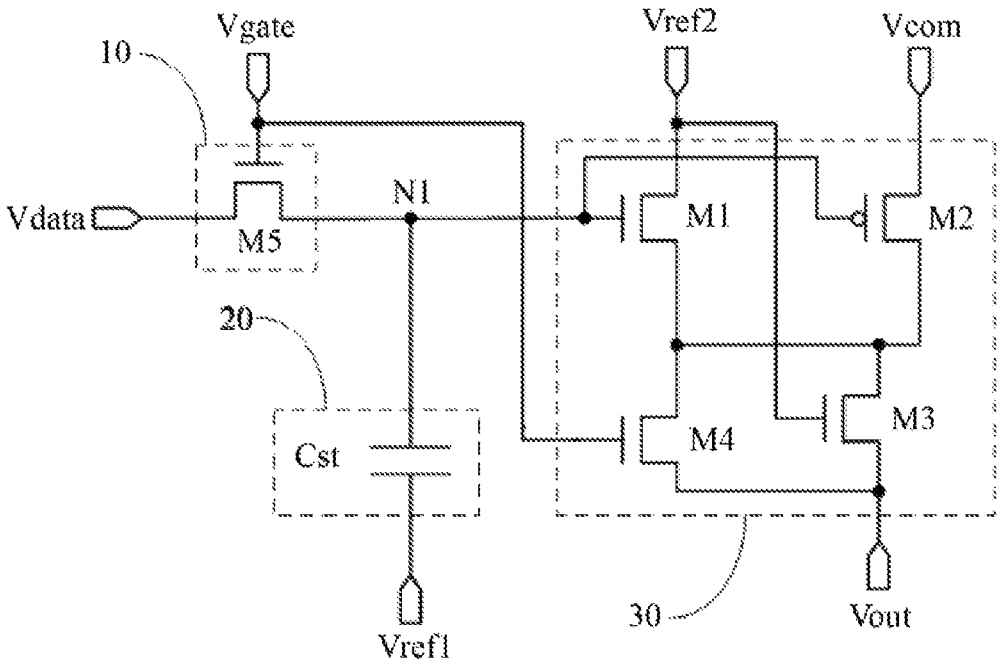
FIG. 2B is a second schematic structural diagram of a data voltage storage circuit in details according to an embodiment of the disclosure.

Particularly in a particular implementation, in the data voltage storage circuit according to the embodiment of the disclosure, as illustrated in FIG. 2A and FIG. 2B, the voltage input subcircuit 10 can include a fifth switch transistor M5, where the fifth switch transistor M5 has a control electrode coupled to the scan signal end Vgate, a first electrode coupled to the data signal end Vdata, and a second electrode coupled to the first node N1.

In a particular implementation, in the data voltage storage circuit according to the embodiment of the disclosure, the fifth switch transistor M5 can be an N-type transistor as illustrated in FIG. 2A and FIG. 2B, or the fifth switch transistor M5 can be a P-type transistor, although the embodiment of the disclosure will not be limited thereto.

In a particular implementation, in the data voltage storage circuit according to the embodiment of the disclosure, when the fifth switch transistor is controlled by a scan signal of the scan signal end to be switched on, it can provide the first node with a data signal of the data signal end.

Particularly in a particular implementation, in the data voltage storage circuit according to the embodiment of the disclosure, as illustrated in FIG. 2A and FIG. 2B, the storage control subcircuit 20 can include a storage capacitor Cst, where the storage capacitor Cst has a first end coupled to the first node N1, and a second end coupled to the first reference voltage signal end Vref1.

In a particular implementation, in the data voltage storage circuit according to the embodiment of the disclosure, the storage capacitor can be charged or discharged according to the signal of the first node and the signal of the first reference voltage signal end. When the first node is floating, the difference in voltage across the storage capacitor can be stabilized due to bootstrapping thereof, that is, the difference in voltage between the first node and the first reference voltage signal end can be stabilized, so that the voltage of the data signal input to the first node can be stabilized.

Particularly in a particular implementation, in the data voltage storage circuit according to the embodiment of the disclosure, as illustrated in FIG. 2A, the output control subcircuit 30 can include a first switch transistor M1, a second switch transistor M2, and a third switch transistor M3.

The first switch transistor M1 has a control electrode coupled to the first node N1, a first electrode coupled to the second reference voltage signal end Vref2, and a second electrode coupled to a first electrode of the third switch transistor M3.

The second switch transistor M2 has a control electrode coupled to the first node N1, a first electrode coupled to the common voltage signal end Vcom, and a second electrode coupled to the first electrode of the third switch transistor M3.

The third switch transistor M3 has a control electrode coupled to the second reference voltage signal end Vref2, and a second electrode coupled to the signal output end Vout.

In a particular implementation, in the data voltage storage circuit according to the embodiment of the disclosure, as illustrated in FIG. 2A, the first switch transistor M1 and the third switch transistor M3 can be N-type transistors, and the second switch transistor M2 can be a P-type transistor. Of course, the first switch transistor M1 can alternatively be a P-type transistor, and the second switch transistor M2 can alternatively be an N-type transistor, although the embodiment of the disclosure will not be limited thereto.

In a particular implementation, in the data voltage storage circuit according to the embodiment of the disclosure, when the first switch transistor is controlled by the signal of the first node to be switched on, it can provide the first electrode of the third switch transistor with the signal of the second reference voltage signal end. When the second switch transistor is controlled by the signal of the first node to be switched on, it can provide the first electrode of the third switch transistor with the signal of the common voltage signal end. When the third switch transistor is controlled by the second reference voltage signal end to be switched on, it can provide the signal output end with the signal input to the first electrode thereof.

Furthermore in order to improve a pathway for outputting the signal of the second reference voltage signal end, in a particular implementation, in the data voltage storage circuit according to the embodiment of the disclosure, as illustrated in FIG. 2B, the output control subcircuit 30 can further include a fourth switch transistor M4, where the fourth switch transistor M4 has a control electrode coupled to the scan signal end Vgate, a first electrode coupled to the second electrode of the first switch transistor M1, and a second electrode coupled to the signal output end Vout.

In a particular implementation, in the data voltage storage circuit according to the embodiment of the disclosure, the fourth switch transistor M4 can be an N-type transistor as illustrated in FIG. 2B, or the fourth switch transistor M4 can be a P-type transistor, although the embodiment of the disclosure will not be limited thereto.

In a particular implementation, in the data voltage storage circuit according to the embodiment of the disclosure, when the fourth switch transistor is controlled by a scan signal of the scan signal end to be switched on, it can provide the signal output end with the signal output from the first electrode of the fourth switch transistor.

The particular structures of the respective subcircuits in the data voltage storage circuit according to the embodiment of the disclosure have only been described above by way of an example, and will not be limited to the structures above according to the embodiment of the disclosure, but can alternatively be other structures known to those skilled in the art, although the embodiment of the disclosure will not be limited thereto.

In a particular implementation, in the data voltage storage circuit according to the embodiment of the disclosure, the second switch transistor M2 can be a P-type switch transistor, and all of the other switch transistors can be N-type switch transistors, as illustrated in FIG. 2A and FIG. 2B. Alternatively the second switch transistor can be an N-type switch transistor, and all of the other switch transistors can be P-type switch transistors, although the embodiment of the disclosure will not be limited thereto.

In a particular implementation, in the data voltage storage circuit according to the embodiment of the disclosure, an N-type switch transistor is switched on at a high potential, and switched off at a low potential; and a P-type switch transistor is switched off at a high potential, and switched on at a low potential.

It shall be noted that the switch transistors as referred to in the embodiment above of the disclosure can be Thin Film Transistors (TFTs), or can be Metal Oxide Semiconductor Field Effect Transistors (MOSFETs), although the embodiment of the disclosure will not be limited thereto. In a particular implementation, the control electrodes of the switch transistors above are their gates, and their first electrodes can be sources or drains thereof while their second electrodes can be the drains or the sources thereof, dependent upon different types of the switch transistors and different signals, although the embodiment of the disclosure will not be limited thereto.

Figure 3:
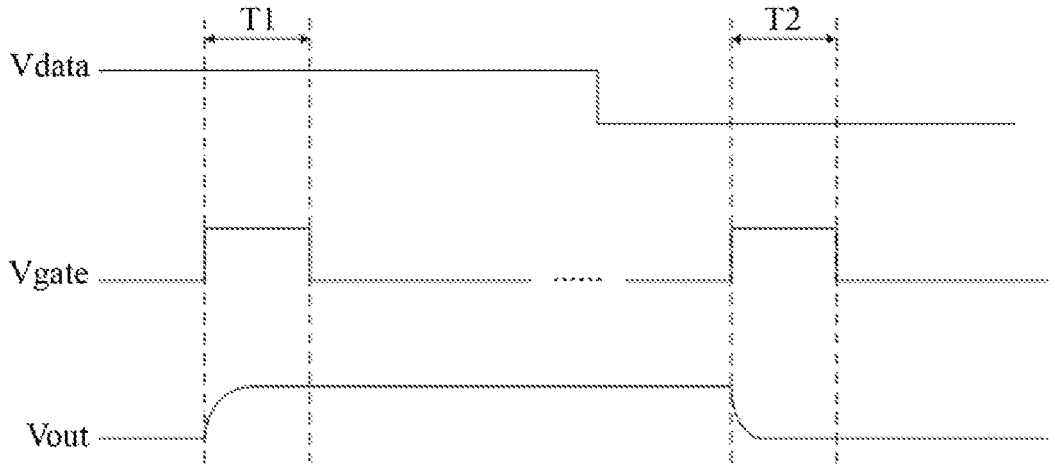
FIG. 3 is a timing diagram of the data voltage storage circuit illustrated in FIG. 2B.

Taking the structure of the data voltage storage circuit illustrated in FIG. 2B as an example, an operating process thereof will be described below with reference to a timing diagram of the circuit illustrated in FIG. 3. In the following description, 1 represents a high-level signal, and 0 represents a low-level signal, where 1 and 0 representing their logic levels are merely intended to better illustrate the operating process of the data voltage storage circuit above according to the embodiment of this discourse, but not to suggest potentials applied to the control electrodes of the respective switch transistors in a particular implementation. Particularly the voltage of the signal of the first reference voltage signal end Vref1 is the same as the voltage of the signal of the common voltage signal end Vcom, for example; and In FIG. 3, there are illustrated a stage T1 in which the data signal is a high-level signal, and a stage T2 in which the data signal is a low-level signal.

In the T1 stage, with Vgate=1, the fifth switch transistor M5 is switched on, and provides the first node N1 with the data signal at a high level at the data signal end Vdata, so that the signal of the first node N1 is a high-level signal, so the storage capacitor Cst is charged to store the voltage of the data signal, the first switch transistor M1 is controlled to be switched on, and the second switch transistor M2 is controlled to be switched off. Since the signal of the second reference voltage signal end Vref2 is a high-level signal to control the third switch transistor M3 to be switched on, the signal of the second reference voltage signal end Vref2 can be output to the signal output end Vout through the first switch transistor M1 and the third switch transistor M3. With Vgate=1, the fourth switch transistor M4 is also switched on, so that the signal of the reference voltage signal end Vref2 can be further output to the signal output end Vout over the pathway formed by the first switch transistor M1 and the fourth switch transistor M4. In the period of time with a high-level signal at the data signal end Vdata, the signal of the second reference voltage signal end Vref2 can be output from the signal output end Vout all the time, and when the signal output from the signal output end Vout is input into a pixel electrode of the liquid crystal display panel, there may be a difference in voltage across the liquid crystal layer to drive liquid crystals to be inverted to display a white image.

In the T2 stage, with Vgate=1, the fifth switch transistor M5 is switched on, and provides the first node N1 with the data signal at a low level at the data signal end Vdata, so that the signal of the first node N1 is a low-level signal, so the storage capacitor Cst is discharged to store the voltage of the data signal, the first switch transistor M1 is controlled to be switched off, and the second switch transistor M2 is controlled to be switched on. Since the signal of the second reference voltage signal end Vref2 is a high-level signal to control the third switch transistor M3 to be switched on, the signal of the common voltage signal end Vcom can be output to the signal output end Vout through the second switch transistor M2 and the third switch transistor M3. With Vgate=1, the fourth switch transistor M4 is also switched on, so that the signal of the common voltage signal end Vcom can be further output to the signal output end Vout over the pathway formed by the second switch transistor M2 and the fourth switch transistor M4. In the period of time with a low-level signal at the data signal end Vdata, the signal of the common voltage signal end Vcom can be output from the signal output end Vout all the time, and when the signal output from the signal output end Vout is input into the pixel electrode of the liquid crystal display panel, there will be no difference in voltage across the liquid crystal layer, so a black image is displayed.

Accordingly in the data voltage storage circuit according to the embodiment of the disclosure, the data signal input to the first node can be stored in the storage capacitor of the storage control subcircuit, and the fifth switch transistors and the storage capacitor cooperate with each other so that the signal output end can be provided with the signal of the second reference voltage signal end or the common voltage signal end using the simple structure to thereby lower the difficulty of a fabrication process thereof, narrow a space to be occupied by the circuit, and improve a pixel aperture ratio.

Based upon the same inventive idea, an embodiment of the disclosure further provides a method for driving the data voltage storage circuit above according to any one of the implementations above of the disclosure, where the method can include the following steps.

The voltage input subcircuit provides the first node with a data signal of the data signal end under control of the scan signal end; the storage control subcircuit stabilizes voltage of the first node; and the output control subcircuit provides the signal output end with the signal of the second reference voltage signal end or a signal of the common voltage signal end under joint control of the second reference voltage signal end and a signal of the first node.

In the driving method above according to the embodiment of the disclosure, the storage control subcircuit stores the data signal input to the first node so that the data signal can be stored for a long period of time to thereby lower a refresh frequency and power consumption. Furthermore the three subcircuits above cooperate with each other so that the signal output end can be provided with the signal of the second reference voltage signal end or the common voltage signal end using the simple structure to thereby lower the difficulty of a fabrication process thereof, narrow a space to be occupied by the circuit, and improve a pixel aperture ratio.

In a particular implementation, in the driving method above according to the embodiment of the disclosure, when the output control subcircuit providing the signal output end with the signal of the second reference voltage signal end under joint control of the second reference voltage signal end and a signal of the first node, the method further comprises: the output control subcircuit provides the signal output end with the signal of the second reference voltage signal end under joint control of the signal of the first node and the scan signal end.

In a particular implementation, in the driving method above according to the embodiment of the disclosure, when the output control subcircuit providing the signal output end with the signal of the common voltage signal end under joint control of the second reference voltage signal end and a signal of the first node, the method further comprises: the output control subcircuit, provides the signal output end with the signal of the common voltage signal end under joint control of the signal of the first node and the scan signal end.

Based upon the same inventive idea, an embodiment of the disclosure further provides a liquid crystal display panel including the data voltage storage circuit above according to any one of the implementations above of the disclosure. The liquid crystal display panel addresses the problem under a similar principle to the data voltage storage circuit above, so reference can be made to the implementation of the data voltage storage circuit above for an implementation of the liquid crystal display panel, and a repeated description thereof will be omitted here.

In a particular implementation, the liquid crystal display panel according to the embodiment of the disclosure is a reflective liquid crystal display panel, and can be applicable to a wearable device.

Figure 4A:
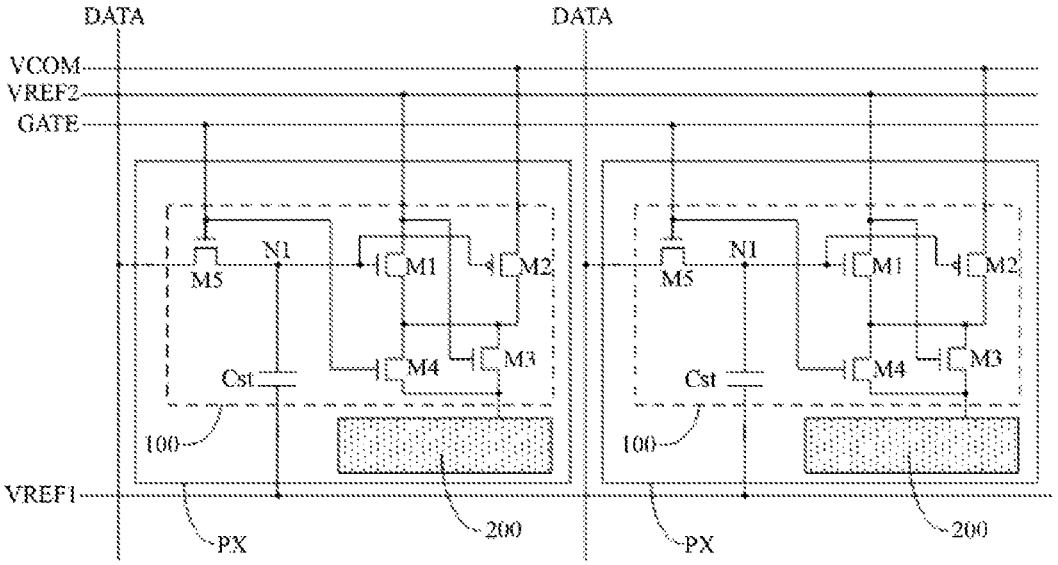
FIG. 4A is a first schematic structural diagram of a display panel according to an embodiment of the disclosure.
Figure 4B:
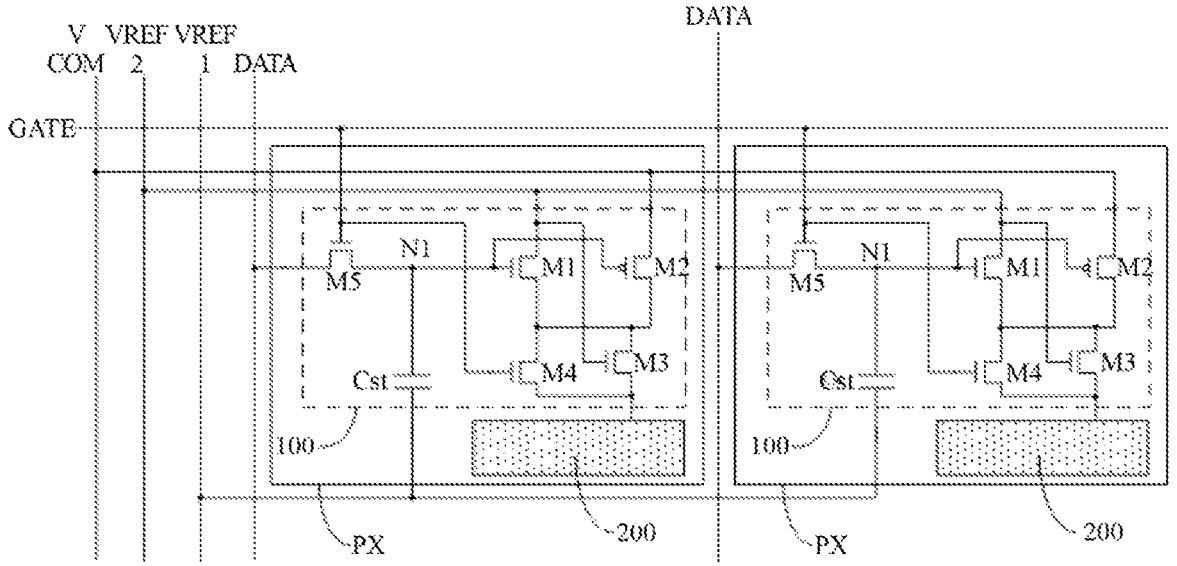
FIG. 4B is a second schematic structural diagram of a display panel according to an embodiment of the disclosure.

In a particular implementation, in the liquid crystal display panel above according to the embodiment of the disclosure, as illustrated in FIG. 4A and FIG. 4B, the liquid crystal display panel includes an array substrate and an opposite substrate arranged opposite to each other, and a liquid crystal layer located between the array substrate and the opposite substrate, where the array substrate includes pixels PX in a plurality of colors, a first reference voltage signal line VREF1, a second reference voltage signal line VREF2, a common voltage signal line VCOM, a plurality of gate lines GATE, and a plurality of data lines DATA. The first reference voltage signal line VREF1, the second reference voltage signal line VREF2, the common voltage signal line VCOM, the respective gate lines GATE, and the respective data lines DATA are arranged insulated from each other.

Each pixel PX can include the data voltage storage circuit 100 and a pixel electrode 200, where the scan signal end of the data voltage storage circuit 100 is electrically coupled to the gate line GATE corresponding to a row including the pixel, the data signal end of the data voltage storage circuit 100 is electrically coupled to the data line DATA corresponding to a column including the pixel, the first reference voltage signal end of the data voltage storage circuit 100 is electrically coupled to the first reference voltage signal line VREF1, the second reference voltage signal end of the data voltage storage circuit 100 is electrically coupled to the second reference voltage signal line VREF2, and the common voltage signal end of the data voltage storage circuit 100 is electrically coupled to the common voltage signal line VCOM.

The shapes and sizes of the respective components in the drawings are not intended to reflect any real proportion of the liquid crystal display panel, but only intended to illustrate the disclosure of the disclosure.

In a particular implementation, in the liquid crystal display panel above according to the embodiment of the disclosure, when the voltage of a signal of the first reference voltage signal end is the same as the voltage of a signal of the common voltage signal end, the first reference voltage signal end of the data voltage storage circuit can be electrically coupled to the common voltage signal line to thereby reduce the number of signal lines, lower the difficulty of wiring, and narrow a space to be occupied by the signal lines.

Figure 5A:
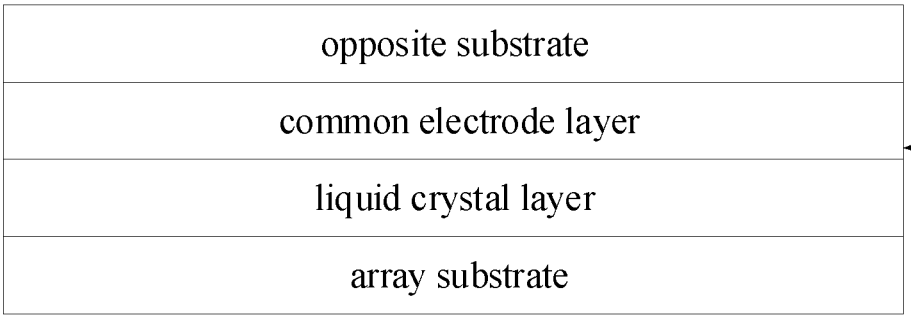
FIG. 5A is a third schematic structural diagram of a display panel according to an embodiment of the disclosure.
Figure 5B:
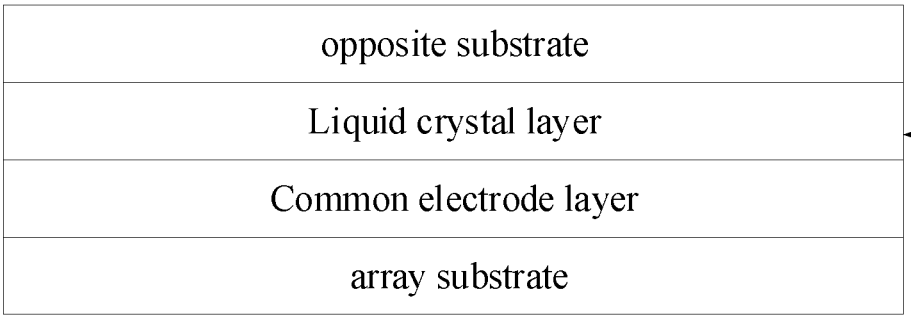
FIG. 5B is a fourth schematic structural diagram of a display panel according to an embodiment of the disclosure.

In a particular implementation, as illustrated in FIG. 5A and FIG. 5B, the liquid crystal display panel above according to the embodiment of the disclosure further includes a common electrode layer located between the opposite substrate and the liquid crystal layer, or between the array substrate and the liquid crystal layer, where the common electrode layer is arranged insulated from the first reference voltage signal line, the second reference voltage signal line, the respective gate lines, and the respective data lines, and the common electrode layer is electrically coupled to the common electrode line.

In a particular implementation, the voltage of a signal on the second reference voltage signal line is different from the voltage of a signal on the common electrode signal line. Generally the voltage of the signal on the second reference voltage signal line is high voltage. When the signal on the second reference voltage line is input by the data voltage storage circuit into the pixel electrode, and a common voltage signal on the common electrode signal line is input to the common electrode layer, there is a difference in voltage across the liquid crystal layer to drive liquid crystals to be inverted so that a white image is displayed on the liquid crystal display panel. When the common electrode signal on the common electrode signal line is input by the data voltage storage circuit into the pixel electrode, and a common voltage signal on the common electrode signal line is input to the common electrode layer, there is no difference in voltage across the liquid crystal layer, so that no liquid crystals are inverted, and this a black image is displayed on the liquid crystal display panel.

In a particular implementation, in the liquid crystal display panel above according to the embodiment of the disclosure, the first reference voltage signal line, the second reference voltage signal line, the common voltage signal line, and the respective gate lines can be made of the same material, and arranged at the same layer, so that one of the first reference voltage signal line, the second reference voltage signal line, the common voltage signal line, and the respective gate lines can be fabricated together with the other signal lines, and thus the other signal lines will not be fabricated in another process, to thereby simplify their fabrication process, and lower their production cost. In order to further lower the difficulty of wiring, in a particular implementation, the first reference voltage signal line VREF1, the second reference voltage signal line VREF2, the common voltage signal line VCOM, and the respective gate lines GATE extend respectively along the row direction of the pixels PX as illustrated in FIG. 4A.

In a particular implementation, in the liquid crystal display panel above according to the embodiment of the disclosure, the first reference voltage signal line, the second reference voltage signal line, the common voltage signal line, and the respective data lines can be made of the same material, and arranged at the same layer, so that one of the first reference voltage signal line, the second reference voltage signal line, the common voltage signal line, and the respective data lines can be fabricated together with the other signal lines, and thus the other signal lines will not be fabricated in another process, to thereby simplify their fabrication process, and lower their production cost. In order to further lower the difficulty of wiring, in a particular implementation, the first reference voltage signal line VREF1, the second reference voltage signal line VREF2, the common voltage signal line VCOM, and the respective data lines DATA extend respectively along the column direction of the pixels PX as illustrated in FIG. 4B.

Based upon the same inventive idea, an embodiment of the disclosure further provides a display device including the liquid crystal display panel above according to the embodiment of the disclosure. The display device can be a mobile phone, a tablet computer, a TV set, a monitor, a notebook computer, a digital photo frame, a navigator, or any other product or component with a display function. All the other components indispensable to the display device shall be appreciated by those ordinarily skilled in the art, so a repeated description thereof will be omitted here, and the embodiment of the disclosure shall not be limited thereto. Reference can be made to the embodiment of the liquid crystal display panel above for an implementation of the display device, so a repeated description thereof will be omitted here.

In the data voltage storage circuit, the method for driving the same, the liquid crystal display panel, and the display device according to the embodiments of the disclosure, the data voltage storage circuit includes the voltage input subcircuit, the storage control subcircuit, and the output control subcircuit, where the voltage input subcircuit is configured under control of the scan signal end to provide the first node with the data signal of the data signal end; the storage control subcircuit is configured to stabilize voltage of the first node; and the output control subcircuit is configured to be controlled jointly by the signals of the second reference voltage signal end and the first node to provide the signal output end with the signal of the second reference voltage signal end or the signal of the common voltage signal end. Accordingly in the data voltage storage circuit according to the embodiment of the disclosure, the storage control subcircuit is arranged to store the data signal input to the first node, so that the data signal can be stored for a long period of time. Furthermore the three subcircuits above cooperate with each other so that the signal output end can be provided with the signal of the second reference voltage signal end or the common voltage signal end using the simple structure to thereby lower the difficulty of a fabrication process thereof, narrow a space to be occupied by the circuit, and improve a pixel aperture ratio. When the data voltage storage circuit is applied to the liquid crystal display panel, the signal of the second reference voltage signal end and the signal of the common voltage signal end are input respectively into the pixel electrode. When the signal of the second reference voltage signal end is input to the pixel electrode, a difference in voltage can be formed across the liquid crystal layer to drive liquid crystals to be inverted to thereby display a white image; and when the signal of the common voltage signal end is input to the pixel electrode, there is no difference in voltage across the liquid crystal layer, and no liquid crystals are inverted, so that a black image is displayed on the liquid crystal display panel.

Evidently those skilled in the art can make various modifications and variations to the disclosure without departing from the spirit and scope of the disclosure. Thus the disclosure is also intended to encompass these modifications and variations thereto so long as the modifications and variations come into the scope of the claims appended to the disclosure and their equivalents.

The invention claimed is:

1. A data voltage storage circuit, comprising a voltage input subcircuit, a storage control subcircuit, and an output control subcircuit, wherein:

the voltage input subcircuit is coupled respectively to a scan signal end, a data signal end and a first node, and is configured to provide the first node with a data signal of the data signal end under control of the scan signal end;

the storage control subcircuit is coupled to the first node and a first reference voltage signal end, and is configured to stabilize voltage of the first node; and the output control subcircuit is coupled respectively to a second reference voltage signal end, a common voltage signal end, the first node and a signal output end of the data voltage storage circuit, and is configured to provide the signal output end of the data voltage storage circuit with the signal of the second reference voltage signal end and a signal of the common voltage signal end respectively at different periods of time, under joint control of the second reference voltage signal end and a signal of the first node, wherein voltage of the signal of the second reference voltage signal end is fixed.

2. The data voltage storage circuit according to claim 1, wherein the storage control subcircuit comprises a storage capacitor; and the storage capacitor has a first end coupled to the first node, and a second end coupled to the first reference voltage signal end.

3. The data voltage storage circuit according to claim 1, wherein the output control subcircuit comprises a first switch transistor, a second switch transistor, and a third switch transistor;

the first switch transistor has a control electrode coupled to the first node, a first electrode coupled to the second reference voltage signal end, and a second electrode coupled to a first electrode of the third switch transistor;

the second switch transistor has a control electrode coupled to the first node, a first electrode coupled to the common voltage signal end, and a second electrode coupled to a first electrode of the third switch transistor; and the third switch transistor has a control electrode coupled to the second reference voltage signal end, and a second electrode coupled to the signal output end.

4. The data voltage storage circuit according to claim 3, wherein the first switch transistor is an N-type switch transistor, and the second switch transistor is a P-type switch transistor; or the first switch transistor is a P-type switch transistor, and the second switch transistor is an N-type switch transistor.

5. The data voltage storage circuit according to claim 3, wherein the output control subcircuit further comprises a fourth switch transistor; and the fourth switch transistor has a control electrode coupled to the scan signal end, a first electrode coupled to the second electrode of the first switch transistor, and a second electrode coupled to the signal output end of the data voltage storage circuit.

6. The data voltage storage circuit according to claim 1, wherein the voltage input subcircuit comprises a fifth switch transistor; and the fifth switch transistor has a control electrode coupled to the scan signal end, a first electrode coupled to the data signal end, and a second electrode coupled to the first node.

7. The data voltage storage circuit according to claim 1, wherein the first reference voltage signal end is the same signal end as the common voltage signal end.

8. A method for driving the data voltage storage circuit according to claim 1, the method comprising:

providing, by the voltage input subcircuit, the first node with the data signal of the data signal end under control of the scan signal end; stabilizing, by the storage control subcircuit, the voltage of the first node; and providing, by the output control subcircuit, the signal output end of the data voltage storage circuit with the signal of the second reference voltage signal end and the signal of the common voltage signal end respectively at the different periods of time, under joint control of the second reference voltage signal end and a signal of the first node.

9. A liquid crystal display panel, comprising a data voltage storage circuit, the data voltage storage circuit comprising a voltage input subcircuit, a storage control subcircuit, and an output control subcircuit, wherein:

the voltage input subcircuit is coupled respectively to a scan signal end, a data signal end and a first node, and is configured to provide the first node with a data signal of the data signal end under control of the scan signal end;

the storage control subcircuit is coupled to the first node and a first reference voltage signal end, and is configured to stabilize voltage of the first node; and the output control subcircuit is coupled respectively to a second reference voltage signal end, a common voltage signal end, the first node and a signal output end of the data voltage storage circuit, and is configured to provide the signal output end of the data voltage storage circuit with the signal of the second reference voltage signal end and a signal of the common voltage signal end respectively at different periods of time, under joint control of the second reference voltage signal end and a signal of the first node, wherein voltage of the signal of the second reference voltage signal end is fixed.

10. The liquid crystal display panel according to claim 9, wherein the liquid crystal display panel comprises an array substrate and an opposite substrate arranged opposite to the array substrate, and a liquid crystal layer located between the array substrate and the opposite substrate, wherein the array substrate comprises pixels in a plurality of colors, a first reference voltage signal line, a second reference voltage signal line, a common voltage signal line, a plurality of gate lines, and a plurality of data lines; and the first reference voltage signal line, the second reference voltage signal line, the common voltage signal line, the plurality of gate lines, and the plurality of data lines are arranged insulated from each other; and each pixel in the plurality of colors comprises the data voltage storage circuit and a pixel electrode, wherein the scan signal end of the data voltage storage circuit is electrically coupled to corresponding one of the gate lines, the data signal end is electrically coupled to corresponding one of the data lines, the first reference voltage signal end is electrically coupled to the first reference voltage signal line, the second reference voltage signal end is electrically coupled to the second reference voltage signal line, and the common voltage signal end is electrically coupled to the common voltage signal line.

11. The liquid crystal display panel according to claim 10, wherein the first reference voltage signal line, the second reference voltage signal line, the common voltage signal line, and the plurality of gate lines are made of the same material, and arranged on the same layer.

12. The liquid crystal display panel according to claim 11, wherein the first reference voltage signal line, the second reference voltage signal line, the common voltage signal line, and the plurality of gate lines extend respectively along a row direction of the pixels in the plurality of colors.

13. The liquid crystal display panel according to claim 10, wherein the first reference voltage signal line, the second reference voltage signal line, the common voltage signal line, and the plurality of data lines are made of the same material, and arranged on the same layer.

14. The liquid crystal display panel according to claim 13, wherein the first reference voltage signal line, the second reference voltage signal line, the common voltage signal line, and the plurality of data lines extend respectively along a column direction of the pixels in the plurality of colors.

15. The liquid crystal display panel according to claim 10, wherein the liquid crystal display panel further comprises a common electrode layer located between the opposite substrate and the liquid crystal layer, or located between the array substrate and the liquid crystal layer.

16. A display device, comprising the liquid crystal display panel according to claim 9.

17. A data voltage storage circuit, comprising a voltage input subcircuit, a storage control subcircuit, and an output control subcircuit, wherein: the voltage input subcircuit is coupled respectively to a scan signal end, a data signal end and a first node, and is configured to provide the first node with a data signal of the data signal end under control of the scan signal end; the storage control subcircuit is coupled to the first node and a first reference voltage signal end; wherein the first reference voltage signal end is the same signal end as a common voltage signal end, and is configured to stabilize voltage of the first node; and the output control subcircuit is coupled respectively to a second reference voltage signal end, the common voltage signal end, the first node and a signal output end of the data voltage storage circuit, and is configured to provide the signal output end of the data voltage storage circuit with the signal of the second reference voltage signal end or a signal of the common voltage signal end under joint control of the second reference voltage signal end and a signal of the first node.

18. The data voltage storage circuit according to claim 17, wherein the output control subcircuit comprises a first switch transistor, a second switch transistor, and a third switch transistor;

the first switch transistor has a control electrode coupled to the first node, a first electrode coupled to the second reference voltage signal end, and a second electrode coupled to a first electrode of the third switch transistor;

the second switch transistor has a control electrode coupled to the first node, a first electrode coupled to the common voltage signal end, and a second electrode coupled to a first electrode of the third switch transistor; and the third switch transistor has a control electrode coupled to the second reference voltage signal end, and a second electrode coupled to the signal output end.

19. The data voltage storage circuit according to claim 18, wherein the output control subcircuit further comprises a fourth switch transistor; and the fourth switch transistor has a control electrode coupled to the scan signal end, a first electrode coupled to the second electrode of the first switch transistor, and a second electrode coupled to the signal output end of the data voltage storage circuit.

20. The data voltage storage circuit according to claim 17, wherein the voltage input subcircuit comprises a fifth switch transistor; and the fifth switch transistor has a control electrode coupled to the scan signal end, a first electrode coupled to the data signal end, and a second electrode coupled to the first node.

* * * * *